US006321392B1

(12) United States Patent
Sim

(10) Patent No.: US 6,321,392 B1
(45) Date of Patent: Nov. 27, 2001

(54) AUTOMATIC CLEANING ASSEMBLY FOR A TOILET BOWL

(75) Inventor: Jae K. Sim, Irvine, CA (US)

(73) Assignee: Xitec Systems, Irvine, CA (US)

( * ) Notice: Subject to any disclaimer, the term of this patent is extended or adjusted under 35 U.S.C. 154(b) by 0 days.

(21) Appl. No.: 09/575,370

(22) Filed: May 22, 2000

Related U.S. Application Data

(60) Provisional application No. 60/142,532, filed on Jul. 7, 1999.

(51) Int. Cl.[7] ..... E03D 9/00
(52) U.S. Cl. ..... 4/225.1
(58) Field of Search ..... 4/225.1, 227.1

(56) References Cited

U.S. PATENT DOCUMENTS 4,312,082 * 1/1982 Murphy et al. ..... 4/225.1
5,042,095 * 8/1991 Schoepe et al. ..... 4/225.1
5,815,850 * 10/1998 Shon ..... 4/225.1
6,151,722 * 11/2000 Lubrano ..... 4/225.1

* cited by examiner

*Primary Examiner*—Charles E. Phillips

(57) ABSTRACT

An automatic cleaning assembly for a toilet bowl includes a body member having an interior cavity therein for receiving a cleaning agent. An inlet is in communication with an interior of the body member and is connectable to a ball cock through a refill tube and an outlet is in communication with an interior of the body member and is connectable to an overflow pipe through a connecting hose. Furthermore, a cap is attached to the body member. The cap is free from apertures therethrough and sealed to said body member to form a sealed space at an upper portion of an interior of the body member. The sealed space ensures that a level of water within said interior cavity of said body member remains at a bottom of the cleaning agent to slowly dissolve the cleaning agent. With the above construction, an improved cleaning assembly for a toilet bowl is provided, which is simple in structure, inexpensive to manufacture, and can clean the toilet bowl thoroughly. Furthermore, it is possible to extend the usable life of the cleaning agent. Furthermore, complete cleaning of a toilet bowl is provided with each flush, such that the necessity of scrubbing and use of chemicals to clean the toilet bowl is substantially reduced or eliminated entirely. Finally, the cleaning agent remains out of the water to prevent excessive dissolving of the cleaning agent and to prevent gaseous cleaning agent from harming the plumbing equipment or a user.

11 Claims, 5 Drawing Sheets

AUTOMATIC CLEANING ASSEMBLY FOR A TOILET BOWL

This application benefit of Provisional 60/142,532 filed Jul. 7, 1999.

BACKGROUND OF THE INVENTION

1. Field of the Invention

The present invention relates to an automatic cleaning assembly for a toilet bowl or a urinal receptacle. More particularly, the present invention relates to a cleaning assembly attached to an inside wall of a toilet water holding tank or a urinal receptacle for discharging a certain amount of cleaning agent in the cleaning assembly through an overflow pipe, so as to conserve the cleaning agent.

2. Description of Related Art

Generally, a cleaning agent is disposed in the flushing water in a toilet water holding tank. Under some circumstances, a cleaning agent in a net pocket is placed into the flushing water in the toilet water holding tank. Upon flushing, a flapper valve opens and simultaneously the flushing water containing the cleaning agent dissolved therein is supplied to the toilet bowl. At this time, the cleaning water flushes the interior of the toilet bowl for only about 2–3 seconds, since the water within the toilet bowl as well as the water flowing through the flapper valve drains out of the toilet bowl to the sewer. Furthermore, once the flapper valve is closed, clean water from the overflow pipe of the toilet flows over the inside of the toilet bowl to fill the toilet bowl. The clean water washes away any cleaning agent that may remain on the inside of the toilet bowl and dilutes the cleaning agent within the toilet bowl. Accordingly, the interior of the toilet bowl is not cleaned perfectly.

In view of this, it is often necessary to use strong cleaning agents in order to keep the toilet bowl sufficiently clean. This causes excessive use of water and environmental problems because of the extra flushing when cleaning and the amount of chemicals that must be used.

Furthermore, the cleaning agent tablet is always submerged within the flushing water in the toilet water holding tank. Therefore, the cleaning agent dissolves in the flushing water very quickly, so that the usable life of the cleaning agent is a maximum of approximately 3 months. Accordingly, it is necessary to replace the cleaning agent tablet very frequently, resulting in an increased cost to keep the toilet clean. It is necessary in the related art to keep the cleaning agent tablet submerged at all times, since if the cleaning agent tablet is allowed to remain out of the water, the air within the holding tank of the toilet will be filled with gaseous cleaning agent. The gaseous cleaning agent can be harmful to the plumbing equipment as well as a user.

SUMMARY OF THE INVENTION

Accordingly, it is an object of the present invention to provide an automatic cleaning assembly for a toilet bowl which eliminates the above problems encountered with conventional cleaning assemblies for a toilet bowl.

Another object of the present invention is to provide an improved cleaning assembly for a toilet bowl, which is simple in structure, inexpensive to manufacture, and can clean the toilet bowl thoroughly. Furthermore, it is an object of the present invention to extend the usable life of the cleaning agent when compared with the Related Art.

It is a further object of the present invention to completely clean a toilet bowl with each flush, such that the necessity of scrubbing and use of chemicals to clean the toilet bowl is substantially reduced or eliminated entirely. A reduction in the amount of scrubbing with chemicals is advantageous, since water is conserved and the environment is protected.

It is yet another object of the present invention to allow the cleaning agent to remain out of the water to prevent excessive dissolving of the cleaning agent and to prevent gaseous cleaning agent from harming the plumbing equipment or a user.

The above objects of the present invention have been accomplished by providing an automatic cleaning assembly for a toilet bowl which includes a body member, said body member including an interior cavity therein for receiving a cleaning agent; an engagement attached to said body member and attachable to a wall of a toilet water holding tank for supporting said body member thereon; an inlet in communication with an interior of said body member and connectable to a ball cock through a refill tube; and an outlet in communication with an interior of said body member and connectable to an overflow pipe through a connecting hose; and a cap attached to said body member, said cap being free from apertures therethrough and sealed to said body member to form a sealed space at an upper portion of an interior of said body member, wherein said sealed space ensures that a level of water within said interior cavity of said body member remains at a bottom of the cleaning agent to slowly dissolve the cleaning agent.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
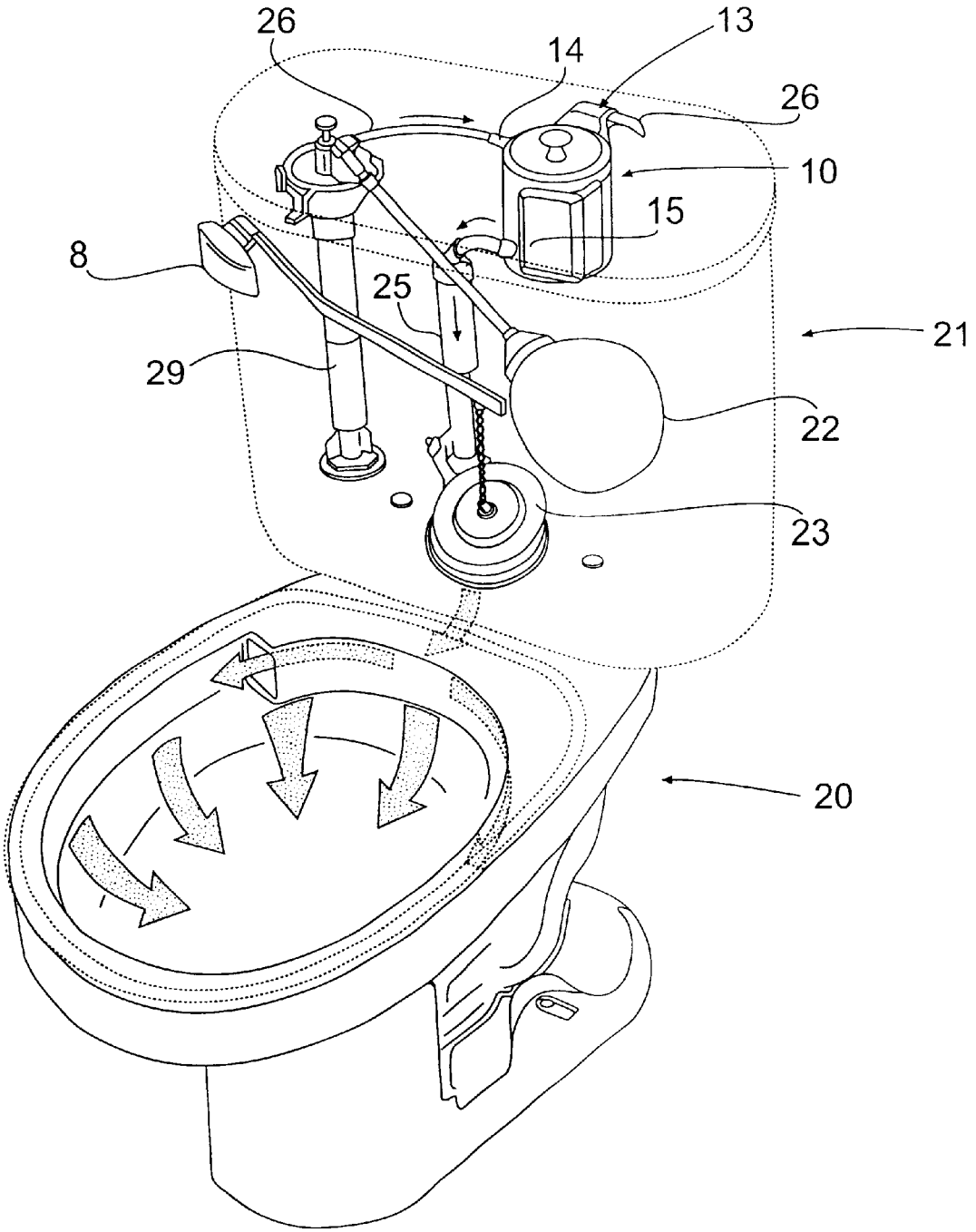
FIG. 1 is a perspective view of an automatic cleaning assembly disposed within a toilet water holding tank according to the present invention.

A first embodiment of the present invention will now be described with reference to FIGS. 1–3. Referring to FIG. 1, the automatic assembly 10 for a toilet bowl 20 or a urinal receptacle includes an engagement or hanger 13 attached to a wall of a toilet water holding tank 21. Furthermore, an inlet 14 is connected to a refill tube 26 and an outlet 15 is connected to an overflow pipe 25.

Figure 2:
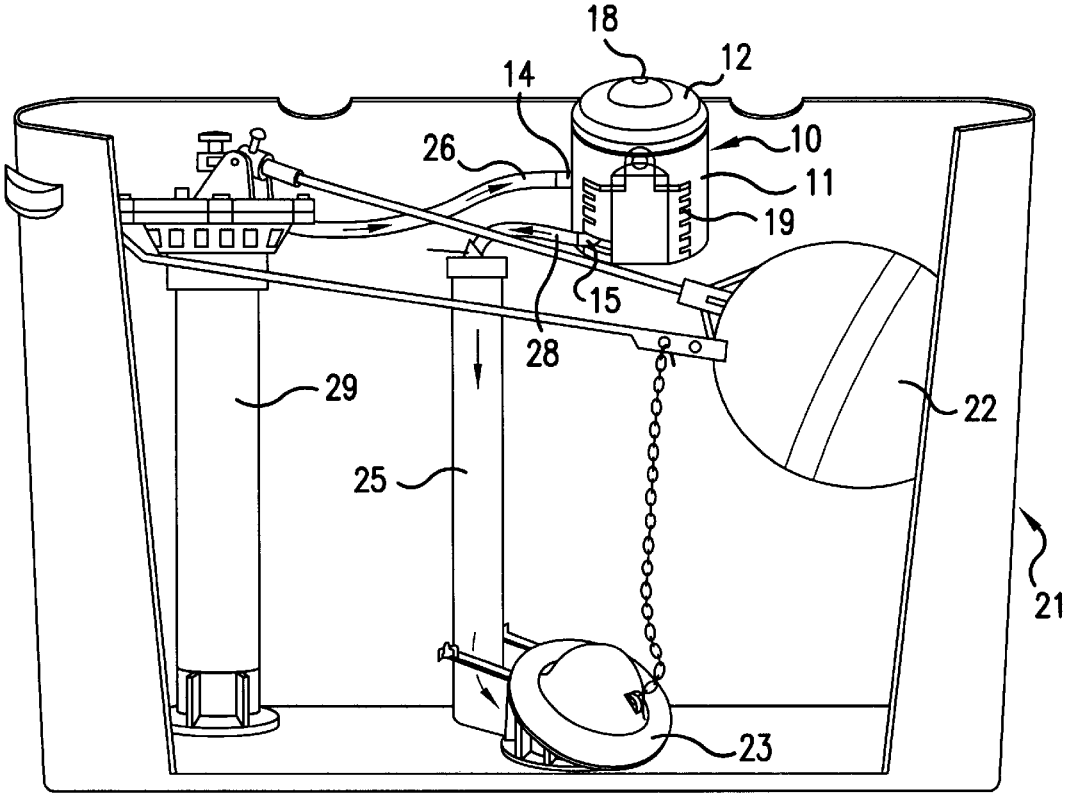
FIG. 2 is an enlarged perspective view of the automatic cleaning assembly disposed within a toilet water holding tank containing cut-away portions in order to illustrate the construction of the apparatus according to the present invention.
Figure 3:
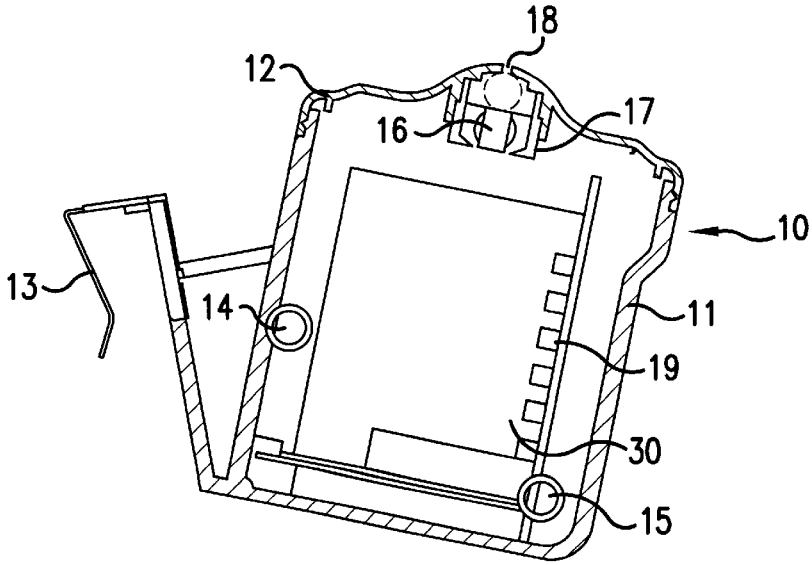
FIG. 3 is a sectional view of the automatic cleaning assembly for a toilet bowl according to the present invention.

Referring to FIGS. 2 and 3, the automatic assembly 10 further includes a cap 12, a body member 11 covered with the cap 12, a cleaning agent holder 19 disposed in the body member 11 for holding a cleaning agent, an air opening 18 disposed at the top of the cap 12, and a ball holder 17 in communication with the air opening 18 and holding a float ball 16.

As shown in FIGS. 1 and 2, the automatic cleaning assembly 10 for a toilet bowl 20 or a urinal receptacle according to the first embodiment of the present invention operates as follows. When a user flushes the toilet by operating a handle to open a flapper valve 23, flushing water is supplied to the inlet 14 of the automatic cleaning assembly through the refill tube 26 from a ball cock 29.

Reference numeral 22 identifies a float assembly of the toilet which controls the operation of the ball cock 29.

At this time, the flushing water fills up the body member 11 gradually and simultaneously drains to the overflow pipe 25 through the outlet 15 and the connecting hose 28. When the cleaning assembly 10 is filled up with water, the float ball 16 on the ball holder 17 moves up and closes the air opening 18, so that the water in the cleaning assembly 10 swirls under the water pressure from the water flowing through the refill tube 26. Therefore, the cleaning agent 30 on the cleaning agent holder 19 dissolves rapidly in the swirling water.

Accordingly, the mixture of water and cleaning agent in the body member 11 is continuously supplied to the overflow pipe 25 for effectively cleaning the toilet bowl 20. Since after the flushing finishes, the flushing water from the ball cock 29 is not supplied to the cleaning assembly 10, the float ball 16 moves down and opens the air opening 18 and the water in the body member 11 drains completely, so that the cleaning agent 30 does not dissolve between flushes. This effectively conserves the life of the cleaning agent 30 when compared with the conventional art.

Since the cleaning agent from the automatic assembly 10 enters the toilet bowl 20 through the overflow pipe 25, even though the flapper valve 23 has closed, the cleaning agent flows all over the interior of the toilet bowl including the sides and under the rim. Furthermore, the cleaning agent remains within the toilet bowl after flushing has been completed and does not drain out of the toilet bowl along with the water exiting the holding tank 21 through the flapper valve 23. Therefore, the interior of the toilet bowl is in contact with the cleaning agent for a longer period of time than the conventional art. Accordingly, the toilet bowl is cleaned more effectively.

Figure 4:
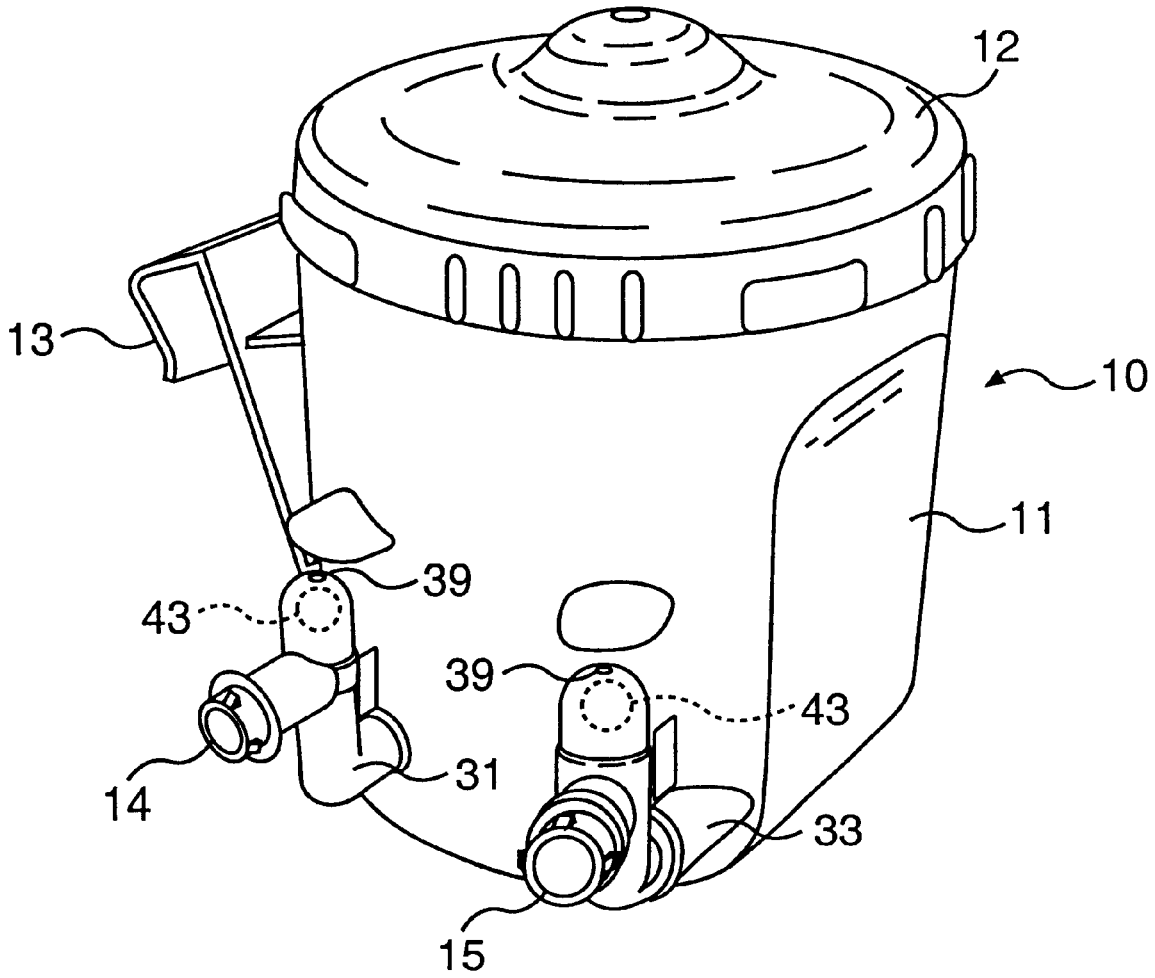
FIG. 4 is a perspective view of a second embodiment of the present invention.
Figure 5:
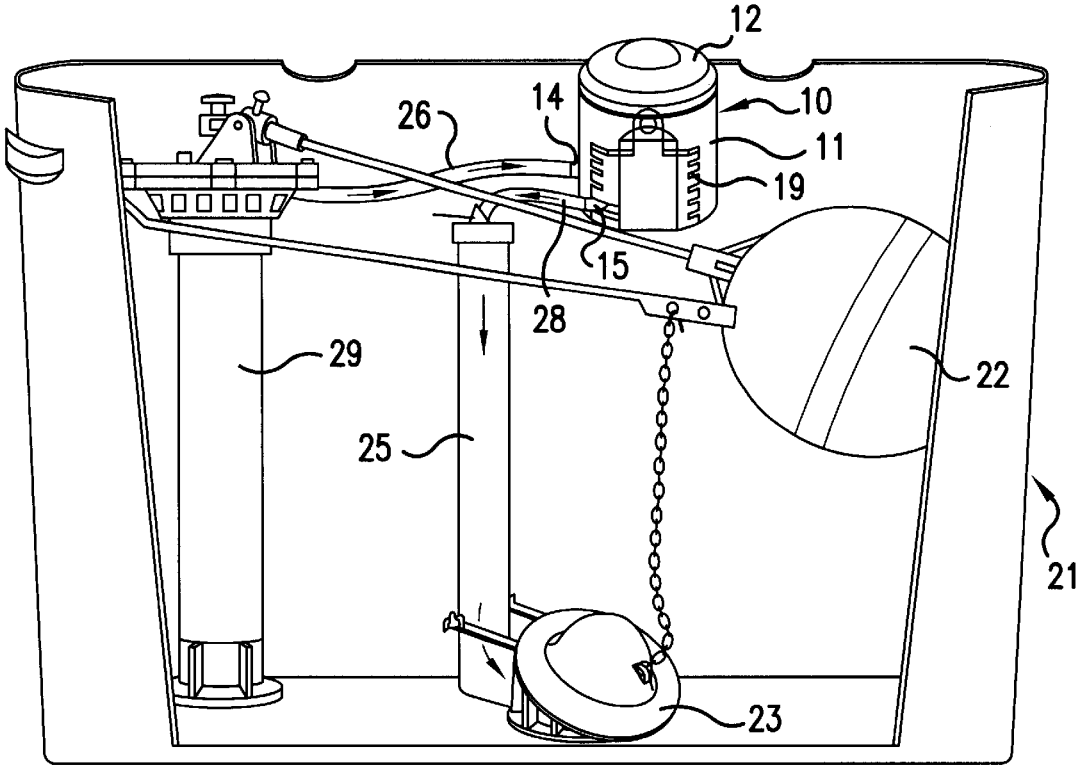
FIG. 5 is an enlarged perspective view of the second embodiment of the automatic cleaning assembly of the present invention disposed within a toilet water holding tank containing cut-away portions in order to illustrate the construction of the apparatus according to the present invention.

A second embodiment of the present invention will now be described with reference to FIGS. 4–7. In the second embodiment, the same reference numerals have been used to identify the same or similar elements. FIG. 4 is a perspective view of the second embodiment of the present invention and FIG. 5 is an enlarged perspective view of the second embodiment of the automatic cleaning assembly of the present invention disposed within a toilet water holding tank containing cut-away portions in order to illustrate the construction of the apparatus according to the present invention.

Figure 6:
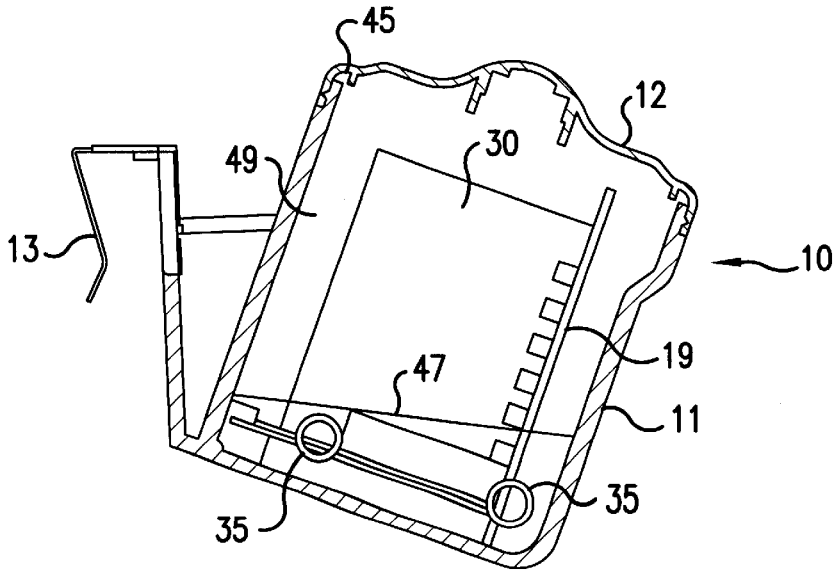
FIG. 6 is a sectional view of the automatic cleaning assembly for a toilet bowl according to the second embodiment of the present invention.

In the second embodiment of the present invention, the construction of the automatic assembly 10 is substantially the same as the first embodiment, except for the location of the inlet 14 and the construction of the cap 12. Referring to FIG. 6, the inlet 14 in the second embodiment of the present invention is located closer to the bottom of the body member 11 than in the first embodiment. Furthermore, the cap 12 does not require the air opening 18 and float ball 16 as in the first embodiment.

However, the operation and resulting effect of the second embodiment of the present invention is different than the first embodiment as will be described below.

Referring to FIG. 4, the inlet 14 and the outlet 15 include elbows 31 and 33, respectively, located between the body member 11 and the inlet and outlet 14 and 15. The elbows 31 and 33 are substantially the same and therefore only the elbow 31 will be described with reference to FIGS. 4 and 7. The elbow 31 includes a horizontal portion 35 and vertical portion 37. The horizontal portion 35 is connected to the body member 11, while the vertical portion 37 is connected at an intermediate portion thereof to the inlet 14. The vertical portion 37 also includes an opening 39 at a top portion thereof and a ball support 41 for supporting a ball 43. The ball 43 cooperates with the opening 39 to open and close the opening 39 to act as a check valve. Furthermore, the ball support includes at least one aperture 42 therein to allow air communication therethrough.

Referring to FIG. 6, the cap 12 includes a seal 45 to seal between the body member 11 and the cap 12. Furthermore, there is no air opening or float ball in the top of the cap 12 such as in the first embodiment. This forms a sealed space 49 above the water level within the body member. This arrangement ensures that the water level remains at a low level within the body member 11 and ensures that the water level does not rise during flushing of the toilet.

The operation of the second embodiment of the present invention will now be described. Referring to FIG. 5, The automatic assembly is supported on the wall of the holding tank 21 by the hanger 13. The ball cock 29 is connected to inlet 14 through the refill tube 26. Furthermore, the outlet 15 is connected to the overflow pipe 25 through the connecting hose 28. Since the body member is sealed with respect to the cap 12 by the seal 45 and there is no air opening provided in the cap 12 as in the first embodiment, the water level is kept at a minimum level within the body member 11 by the air pressure within the body member 11. This level is approximately identified in FIG. 6 by reference numeral 47 such that the water level remains above the horizontal portions 35 of the elbows 31 and 33. Furthermore, since the hanger 13 orients the body member in a tilted manner as illustrated in FIG. 6, the water level at the horizontal portion 35 on the elbow 33 is at a higher level than at the horizontal portion 35 of the elbow 31. Since the water level remains at a low level in the body member 11, the cleaning agent 30 is not sitting entirely within the water. Accordingly, the cleaning agent does not dissolve quickly. Furthermore, since the water level is higher at the location of the horizontal portion of the elbow 33, bubbles that may be present in the water due to the swirling of the water within the body member are prevented from flowing out of the outlet 15.

When a user flushes the toilet, water at a pressure of approximately 35 psi flows from the ball cock 29 through the refill tube 26 and elbow 31 to the inside of the body member 11. The water swirls around the inside of the body member 11 in contact with the bottom of the cleaning agent 30 to dissolve the cleaning agent. The water level remains at a low level due to the air pressure within the body member 11 due to the sealing of the cap 12. The water with dissolved cleaning agent therein flows out of the elbow 33 and the outlet 15, through the connecting hose 28 to the overflow pipe 25 to clean the inside of the toilet bowl 20. Since the water with the cleaning agent enters through the overflow pipe 25, the dissolved cleaning agent contacts all of the inner surfaces of the toilet bowl 20 for the entire time of refill of the toilet bowl and the dissolved cleaning agent remains in the toilet bowl after the flushing is finished. This provides a very thorough cleaning of the toilet bowl such that additional scrubbing with a strong bowl cleaner is unnecessary.

Figure 7:
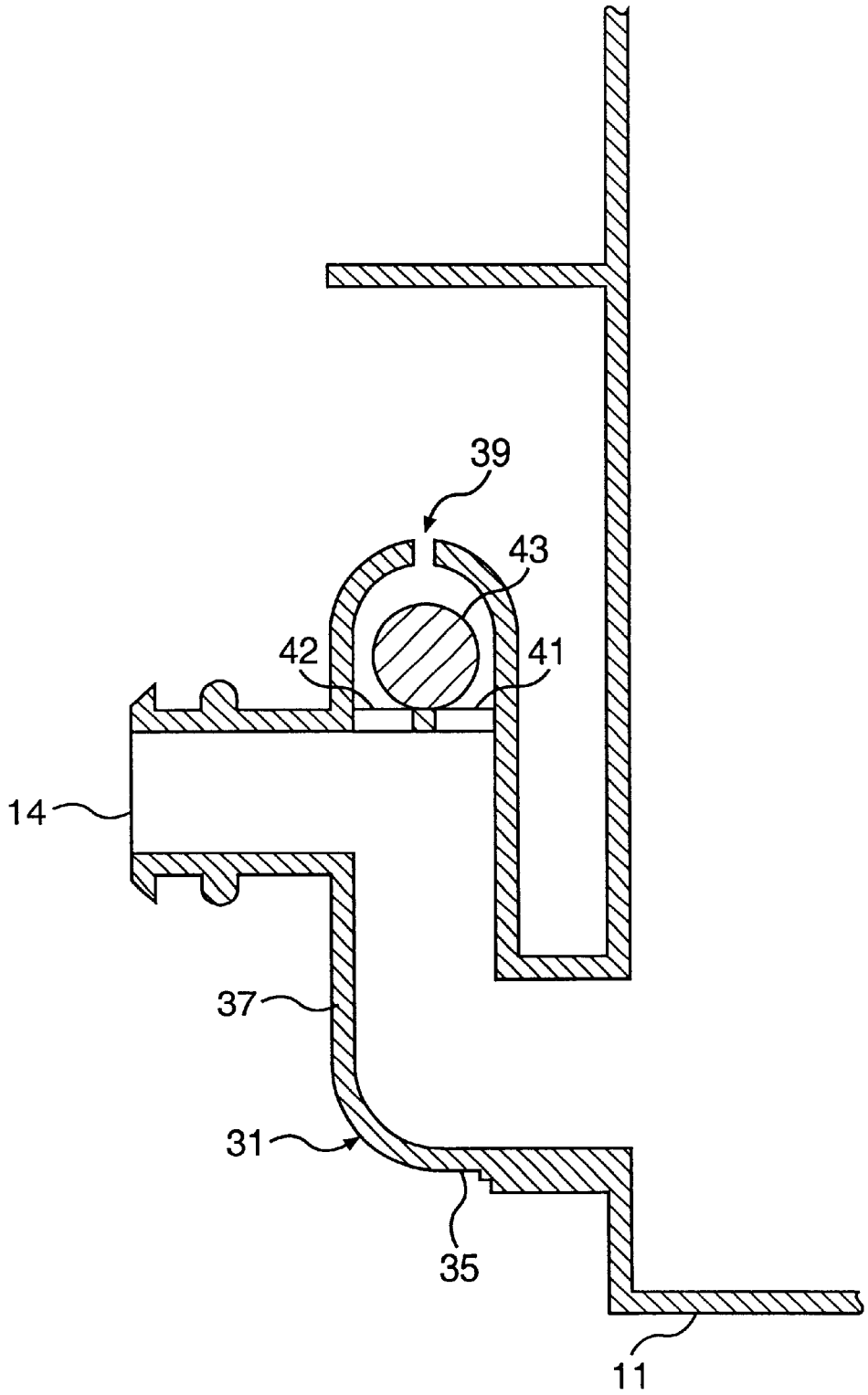
FIG. 7 is a cross-sectional view of the inlet of the second embodiment of the present invention.

The operation of the check valve within the elbows 31 and 33 will now be described with reference to FIG. 7. When water flows through the inlet 14 and the elbow 31, the ball 43 within the elbow is forced upwardly to close the opening 39. Furthermore, when the water flows out of the elbow 33 and outlet 15, the ball 43 is forced upwardly to close the opening 39 in the elbow 33. When the flushing is completed, the balls 43, 43 within the elbows 31 and 33 move back down onto the ball supports 41, 41 to open the openings 39, 39. This causes the liquid and gas within the body member 11 to remain in the body member 11 and not flow out of the inlet 14 and outlet 15 due to siphoning action. It is especially important that the gas within the body member 11 be prevented from flowing out of the inlet 14 and outlet 15, since this gas includes gaseous cleaning agent therein. This gaseous cleaning agent if allowed to flow out of the inlet 14 can damage the plumbing equipment within the holding tank 21, especially the plumbing equipment above the water level in the holding tank 21. Furthermore, the gaseous cleaning agent if allowed to flow out of the outlet 15 can enter the toilet bowl 20 and gain access to the outside of the toilet and the user.

In addition, during flushing, since the water is not siphoned out of the body member 11 due to the check valves in the elbows 31 and 33, and the fact that the horizontal portion 35 of the elbow 33 is located substantially below the water level, any air bubbles that may be caused by the swirling action of the water during flushing do not flow out of the outlet 15 to the toilet bowl 20. This will also prevent the gaseous cleaning agent from entering the toilet bowl 20 to be exposed to the user.

Accordingly, it is an object of the present invention to provide an automatic cleaning assembly for a toilet bowl which eliminates the above problems encountered with conventional cleaning assemblies for a toilet bowl.

With the above construction according to the present invention, the present invention provides an improved cleaning assembly for a toilet bowl, which is simple in structure, inexpensive to manufacture, and can clean the toilet bowl thoroughly. Furthermore, with the present invention, it is possible to extend the usable life of the cleaning agent when compared with the Related Art.

In addition, the present invention provides complete cleaning of a toilet bowl with each flush, such that the necessity of scrubbing and use of chemicals to clean the toilet bowl is substantially reduced or eliminated entirely. Finally, the present invention allows the cleaning agent to remain out of the water to prevent excessive dissolving of the cleaning agent and to prevent gaseous cleaning agent from harming the plumbing equipment or a user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic cleaning assembly for a toilet bowl, comprising:

a body member, said body member including an interior cavity therein for receiving a cleaning agent;

an engagement attached to said body member and attachable to a wall of a toilet water holding tank for supporting said body member thereon;

an inlet in communication with an interior of said body member and connectable to a ball cock through a refill tube;

an outlet in communication with an interior of said body member and connectable to an overflow pipe through a connecting hose;

a cap attached to said body member, said cap being free from apertures therethrough and sealed to said body member to form a sealed space at an upper portion of an interior of said body member, wherein said sealed space ensures that a level of water within said interior cavity of said body member remains at a bottom of the cleaning agent to slowly dissolve the cleaning agent; and wherein at least one of said inlet and said outlet includes a check valve therein, said check valve preventing water and gas within said interior cavity of said body member from flowing out of said interior cavity due to siphoning action when flushing is completed.

2. The automatic cleaning assembly of claim 1, further comprising a cleaning agent holder, said cleaning agent holder being located within said interior cavity of said body member for supporting said cleaning agent.

3. The automatic cleaning assembly of claim 1, wherein said check valve includes an opening between said at least one of said inlet and said outlet and said body member, and a ball for opening and closing said opening.

4. The automatic cleaning assembly of claim 1, wherein each of said inlet and said outlet includes a check valve therein.

5. The automatic cleaning assembly of claims 4, wherein said check valve includes an opening between each of said inlet and said outlet and said body member, and a ball for opening and closing each of said openings.

6. An automatic cleaning assembly for a toilet bowl, comprising:

a body member, said body member including an interior cavity therein for receiving a cleaning agent;

an engagement attached to said body member and attachable to a wall of a toilet water holding tank for supporting said body member thereon;

an inlet in communication with an interior of said body member and connectable to a ball cock through a refill tube;

an outlet in communication with an interior of said body member and connectable to an overflow pi pe through a connecting hose;

a cap attached to said body member, said cap being free from apertures therethrough and sealed to said body member to form a sealed space at an upper portion of an interior of said body member, wherein said sealed space ensures that a level of water within said interior cavity of said body member remains at a bottom of the cleaning agent to slowly dissolve the cleaning agent; and wherein said engagement orients said body member at an angle on the wall of the toilet water holding tank such that the water level is higher at the outlet than the inlet.

7. The automatic cleaning assembly of claim 6, further comprising a cleaning agent holder, said cleaning agent holder being located within said interior cavity of said body member for supporting said cleaning agent.

8. The automatic cleaning assembly of claim 6, wherein at least one of said inlet and said outlet includes a check valve therein, said check valve preventing water and gas within said interior cavity of said body member from flowing out of said interior cavity due to siphoning action when flushing is completed.

9. The automatic cleaning assembly of claim 8, wherein said check valve includes an opening between said at least one of said inlet and said outlet and said body member, and a ball for opening and closing said opening.

10. The automatic cleaning assembly of claim 8, wherein each of said inlet and said outlet includes a check valve therein.

11. The automatic cleaning assembly of claim 10, wherein said check valve includes an opening between each of said inlet and said outlet and said body member, and a ball for opening and closing each of said openings.

* * * * *